US005348531A

United States Patent [19]

Brown et al.

[11] Patent Number: 5,348,531

[45] Date of Patent: Sep. 20, 1994

[54] WRAP-ON FINGER HOOKS

[75] Inventors: Nancy M. Brown, Milwaukee; Debra A. Reina, Menomonee Falls; Carl E. Krippendorf, Milwaukee, all of Wis.

[73] Assignee: Smith & Nephew Rolyan, Inc., Menomonee Falls, Wis.

[21] Appl. No.: 989,152

[22] Filed: Dec. 11, 1992

[51] Int. Cl.[5] ..... A61F 5/04

[52] U.S. Cl. ..... 602/22; 601/40

[58] Field of Search ..... 482/47, 48; 602/21, 602/22, 60, 45, 77; 128/26; 2/21

[56] References Cited

U.S. PATENT DOCUMENTS

| | | | |
|---|---|---|---|
| 494,197 | 3/1893 | Hall | 482/48 |
| 1,736,930 | 11/1929 | Marsh | 482/48 |
| 2,146,933 | 2/1939 | Budin | 602/22 |
| 3,347,547 | 10/1967 | Hynes . | |
| 3,973,563 | 8/1976 | Green et al. | 602/77 |
| 4,194,736 | 3/1980 | Loafman | 2/21 |
| 4,220,334 | 9/1980 | Kanamoto et al. | 482/48 |
| 4,655,207 | 4/1987 | Ellis | 128/871 |
| 4,790,301 | 12/1988 | Silfverskiold . | |
| 4,875,469 | 10/1989 | Brook et al. . | |

FOREIGN PATENT DOCUMENTS

| | | | |
|---|---|---|---|
| 2576512 | 8/1986 | France | 482/48 |

*Primary Examiner*—Richard J. Apley
*Assistant Examiner*—Jeanne M. Mollo
*Attorney, Agent, or Firm*—Pravel, Hewitt, Kimball & Krieger

[57] ABSTRACT

The present invention relates to a wrap-on finger hook for use with hand splinting devices used in finger rehabilitation programs. The wrap-on finger hook has a finger hook portion that is formed from an ultra thin strapping material, having an exterior grappling surface and an interior non-slip surface. A hook is secured to the exterior surface of wrap-on finger hook for use in selectively attaching tensioning devices to the finger of a human hand. A fastening strap with a loop gender surface is attached to the finger hook portion for releasably fastening the finger hook portion around the finger of a human hand.

5 Claims, 1 Drawing Sheet

WRAP-ON FINGER HOOKS

FIELD OF THE INVENTION

This invention relates to a finger attachment device for use in a finger rehabilitation program to increase the range of motion of an injured finger.

BACKGROUND OF THE INVENTION

The subject invention provides a wrap around finger attachment device for attaching hooks to a patient's fingers for use in a finger rehabilitation program when the range of finger motion has been diminished due to post tendon injury, hand surgery, crush or traumatic hand injury, a burned hand or finger tip amputations. A finger rehabilitation program is typically used to overcome muscle degeneration and internal adhesions of the muscles, tendons or ligaments and to increase the range of motion of the entire finger. The finger rehabilitation programs may, for example, consist of static progressive finger stretching, finger flexion and extension exercises or the use of continuous passive motion devices. In such programs, tensioning devices such as rubber bands, monofilament (nylon) line or spring forces are attached between the affected fingers and hand-mounted dynamic or static splinting devices or continuous passive motion machines to provide resistance.

In such devices, the finger attachment portion includes hooks attached to the fingers. A tensioning device is then attached between the finger hooks and the dorsal or palmar region of a hand splint or the proximal area on the wrist or forearm. The tensioning device applies tension or movement to the fingers.

Typically, the finger hooks are glued directly on to the finger nails in order to obtain correct placement of the hooks. However, glue-on hooks tend to be a nuisance and be in the way when not being used and, frequently, the hooks become loose and have to be reapplied. It is also difficult to glue hooks directly onto the fingernail beds of burn patients or to hand trauma patients with sensitive nail beds. In finger tip amputations there are no nails to glue the hooks onto.

One attempt, to develop a finger exercising device involved placing finger hooks on the outer surface of a glove, as shown in U.S. Pat. No. 3,347,547. This device inhibited the range of motion of the fingers and prevented the position of the hooks from being changed.

Another finger attachment device, this one for use with a continuous passive motion (CPM) machine, is described in U.S. Pat. No. 4,875,469. The finger attachment devices are formed of a molded base conforming to the finger, bound on each side by a hinge that joins adjacent side panels and secured around the finger with an elastic band. The tensioning device is connected to a protruding lever arm on the finger attachment. This device has limited adjustability and can not be used on burn patients or patients with sensitive fingernail beds.

Thus, there is a need for a finger attachment device that allows for total adjustability for finger size and shape and can also be used with a variety of traction devices available for finger rehabilitation. Additionally, there is a need for a finger attachment device that can be used in finger rehabilitation programs with burn patients, patients with sensitive nail beds, patients with finger tip amputations or patients with general hand trauma in which finger hooks cannot be glued to the nail bed or when it is deemed undesirable by the treating therapist or physician to use glue-on hooks.

SUMMARY OF THE INVENTION

The invention solves the problems discussed above by providing a finger attachment device that makes it possible to stabilize a finger hook without attaching the hook to the nail, that is adjustable, and that can be easily applied and removed when needed for finger rehabilitation programs. The invention also allows the patient to achieve a greater range of motion in the fingers without inhibiting or changing position of the finger hooks during the rehabilitation program.

The wrap-on finger hook is formed of two parts, a finger hook portion and a fastening strap. The finger hook portion is made of a very thin strapping material with a non-slip material on the interior surface. A metal hook is attached to the exterior surface of the finger hook portion.

The fastening strap is formed of material that is suitable for the hook gender of a VELCRO TM fastening system. The fastening strap is attached to the finger hook portion by any suitable attachment means such as, for example, sewing or a sonic weld. The finger hook portion is placed on the desired location of the finger and the fastening strap wraps around the finger and engages the exterior surface of the finger hook portion in order to keep the wrap-on finger hook positioned on the finger.

The non-slip material on the interior surface of the finger hook portion totally encompasses the finger when the wrap-on finger hook is in place. This non-slip material acts as a counter-force to the shear force created by the tensioning devices and maintains the wrap-on finger hook securely on the finger. The tensioning devices, such as rubber bands, monofilament (nylon) line and spring forces are attached to the hook on the wrap-on finger hook and to the splinting devices used in hand based dynamic or static splints. The wrap-on finger hooks can also be used with continuous passive motion devices.

The wrap-on finger hook is used with a hand splint designed for application with one or more fingers in dynamic, progressive finger rehabilitation programs to increase range of motion of the fingers.

BRIEF DESCRIPTION OF THE DRAWINGS

The objects, advantages and features of the invention will become more apparent when the detailed description of exemplary embodiments is considered in conjunction with the appended drawings, in which.

DETAILED DESCRIPTION OF A PREFERRED EMBODIMENT

Figure 1:
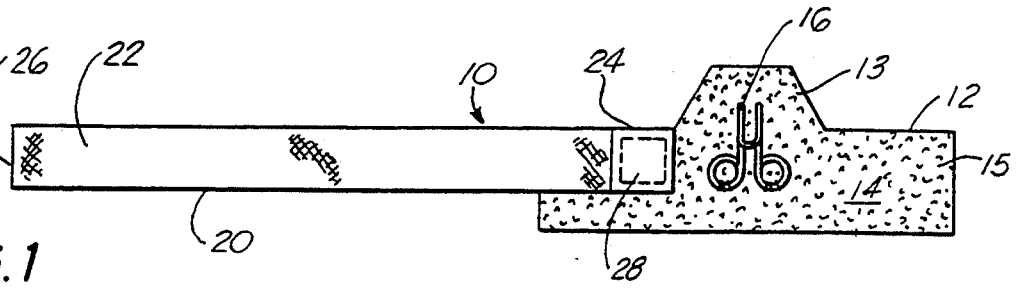
FIG. 1 is a plan view of the exterior surface of a wrap-on finger hook according to the present invention.

In accordance with the present invention, a wrap-on finger hook 10 is with two parts, a finger hook portion 12 and a fastening strap 20. As shown in FIG. 1, the finger hook portion 12 includes a tab quadrangle 13 that is centrally positioned above a larger rectangular portion 15 and is approximately 1.0 inch wide and 2.5 inches long. The finger hook portion 12 is preferably formed of an ultra thin strapping material having an exterior surface 14 which is suitable as a grappling surface.

The ultra thin strapping material may be formed of any high strength, tight weaved fabric, in which case a loose weaved fabric providing a suitable loop gender of a VELCRO TM fastening system can be applied to the exterior surface 14 of the finger hook portion 12. Preferably, however, the finger hook portion 12 is made of a loose weaved fabric suitable for use as the loop gender of a VELCRO TM fastening system which also has a high tensile strength.

In a preferred embodiment, a #3 metal hook 16 is centrally located on the exterior surface 14 of the finger hook portion 12. The hook 16 may be secured to the exterior surface 14 by any suitable attachment means such as, for example, by sewing in place.

Figure 2:
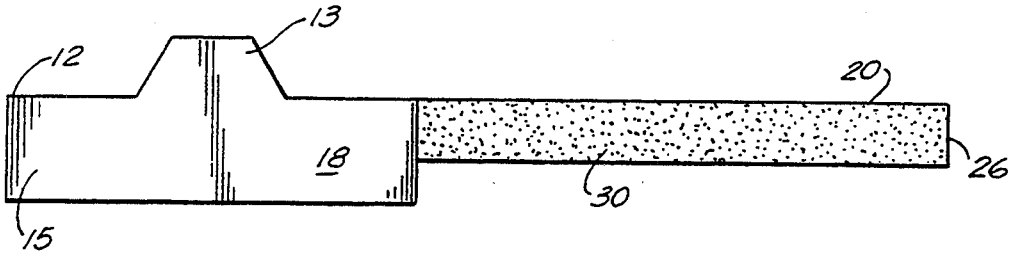
FIG. 2 is a plan view of the interior surface of a wrap-on finger hook of FIG. 1.

Referring to FIG. 2, an interior surface 18 of the finger hook portion 12 is covered with a non-slip material. Preferably, the non-slip material on the interior surface 18 is composed of DYCEM TM which is made from a pure PVC compound with a non-migratory plasticizer. DYCEM TM can be obtained from DYCEM LTD, Ashley Hill Trading Estate Bristol, Bristol, England, BS2 9XS. The non-slip material DYCEM TM provides a surface that acts as a counter force to the shear force created by the tensioning devices and maintains the wrap-on finger hook 10 in place on a finger F as illustrated in FIG. 3.

The fastening strap 20 is formed of material that is suitable for the hook gender of a VELCRO TM fastening system. The exterior surface 22 of the fastening strap 20 is smooth. The interior surface 30 of the fastening strap 20, as illustrated in FIG. 2, is formed of a VELCRO TM hook fastening material or a surface that is suitable for use as the hook gender of a VELCRO TM fastening system. Preferably, the fastening strap 20 is formed of ⅜" wide VELCRO TM hook fabric and is generally 4"long. The fastening strap 20 has an inner end 24 and an outer end 26, the inner end 24 being secured to the exterior surface 14 of the finger hook portion 12 at a location generally near the base of the tab 13. The inner end 24 is secured to the exterior surface 14 through any suitable means, such as sewing or a sonic weld 28.

Figure 3:
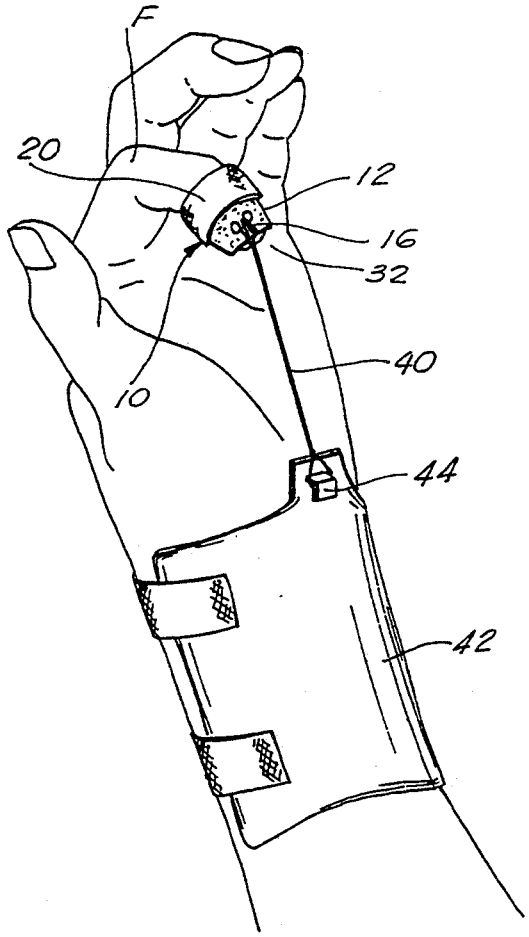
FIG. 3 is a perspective view of a wrap-on finger hook according to the present invention applied to a human hand.

As shown in FIG. 3, the wrap-on finger hook 10 is placed on the finger F so that the hook 16 is positioned over the finger nail 32. However, the wrap-on finger hook 10 can be positioned on the finger in any location appropriate for the rehabilitation program being used. The finger hook portion 12 wraps around the finger F with the interior surface 18 of the finger hook portion 12 totally encompassing the finger. The fastening strap 20 wraps around the finger hook portion 12 and engages with the loop gender exterior surface 14 of the finger hook portion 12 to provide the appropriate pressure necessary to hold the wrap-on finger hook 10 in place. This allows the hook 16 to be positioned in such a manner that a tensioning device 40, in the form of an elastic band or the like, can be attached to the hook 16 of the wrap-on finger hook 10. The tensioning device 40 is then attached to a hook or other attachment means 44 on a hand splinting traction device 42.

In finger rehabilitation programs the wrap-on finger hook 10 operates using the leverage principles of normal finger range of motion and assists the finger joint axis function as the patient flexes or extends fingers and thereby stimulates a more natural range of motion. The wrap-on finger hook 10 allows for stretching of the intrinsic and extrinsic muscles and tendons, and the collateral ligaments of the finger joints. The wrap-on finger hook 10 also allows for complete intrinsic and extrinsic muscle and tendon activity. Additionally, the wrap-on finger hook 10 can easily be repositioned as different dynamic and static hand splinting devices and CPM machines are used.

When the invention is used, the wrap-on finger hook 10 can be used to rehabilitate an individual finger of the hand, all fingers can be exercised simultaneously, or in any combination thereof. Since the wrap-on finger hook 10 is adjustable and easily applied and removed, it can be used with burn patients, patents with any kind of hand trauma that produces sensitive nail beds, patients with finger tip amputations or where glue-on finger nail hooks are not appropriate.

The wrap-on finger hook made in accordance with the invention offers the advantages of being adjustable for both finger size and shape, of being easily applied and removed, and of being adoptable for use with a variety of hand splinting devices available in finger rehabilitation programs. Although the present invention has been described with reference to its preferred embodiments, those skilled in the art will recognize changes which may be made in form or structure which do not depart from the spirit of the invention already described in the specification and embodied in the claims which follows.

What is claimed is:

1. A wrap-on finger hook for use with hand splinting devices used in finger rehabilitation programs, comprising:

a) a finger hook portion formed of a thin strapping material, including a tab portion projecting from a wrap around portion with interior and exterior sides;

b) a grappling surface applied to at least a portion of the external side of the finger hook portion formed of one gender of a hook and loop fastening system, and further including a strap connected to the finger hook portion for wrapping around an end portion of a finger and including a portion formed of a second gender of a hook and loop fastening system for engaging said gripping surface;

c) a relatively non-slip surface applied to the interior side of the finger hook portion;

d) a hook means centrally secured to the exterior side of said tab portion, said hook means adapted for use in selectively attaching tensioning devices to the finger of a human hand;

wherein the wrap-on finger hook releasably attaches to the end portion of a finger a human hand for use in a finger rehabilitation program.

2. The wrap-on finger hook of claim 1, wherein the finger hook portion is formed from an ultra thin strapping material with a high tensile strength, with the exterior side including the loop gender of a hook and loop fastening system.

3. The wrap-on finger hook of claim 1, wherein the relatively non-slip surface includes a pure PVC compound with a non-migratory plasticizer.

4. The wrap-on finger hook of claim 1, wherein the hook means includes a #3 metal hook.

5. A wrap-on finger hook for use with hand splinting devices used in finger rehabilitation programs, comprising:

a) a finger hook portion formed of an ultra thin strapping material with a high tensile strength having the loop gender of a hook and loop fastening system, said finger hook portion being generally in the shape of a quadrangle centrally positioned above a larger rectangle having an exterior and an interior side;

b) a non-slip surface applied to the interior side of the finger hook portion for providing a counter force to the shear force created by a tensioning device, said non-slip surface formed from a pure PVC compound with a non-migratory plasticizer;

c) a hook centrally secured to the exterior side of the finger hook portion, said hook for use in selectively attaching tensioning devices to an end portion of a finger of a human hand;

d) a fastening strap attached to the finger hook portion for releasably fastening the finger hook portion around the end portion of a finger of a human hand, said fastening strap being formed of a material having the hook gender of a hook and loop fastening system;

wherein the wrap-on finger hook releasably attaches to the end portion of a finger of a human hand for use in a finger rehabilitation program.

* * * * *